United States Patent [19]

Adams

[11] 4,424,646

[45] Jan. 10, 1984

[54] VENT-TYPE WINDOW WITH EMERGENCY EGRESS MOUNTING

[75] Inventor: Sherman C. Adams, Bradenton, Fla.

[73] Assignee: Alcan Aluminum Corporation, Cleveland, Ohio

[21] Appl. No.: 368,101

[22] Filed: Apr. 14, 1982

[51] Int. Cl.[3] ..... E05B 65/10

[52] U.S. Cl. ..... 49/141; 49/250; 49/465

[58] Field of Search ..... 49/141, 246, 248, 250–253, 49/371, 463, 465

[56] References Cited

U.S. PATENT DOCUMENTS

| | | | |
|---|---|---|---|
| 1,904,110 | 4/1933 | Wittmann | 49/465 X |
| 4,327,523 | 5/1982 | Growely | 49/141 |
| 4,364,201 | 12/1982 | Taylor | 49/248 |

FOREIGN PATENT DOCUMENTS

| | | | |
|---|---|---|---|
| 595765 | 4/1960 | Canada | 49/251 |

*Primary Examiner*—Kenneth Downey

*Attorney, Agent, or Firm*—Cooper, Dunham, Clark, Griffin & Moran

[57] ABSTRACT

A vent-type window structure, having one or more vent sashes each mounted by means of a pair of hinges respectively disposed at the opposite sides of the sash, wherein at least one of the sashes is positively secured to each of its associated hinges only by a single manually removable pin, to facilitate rapid removal of the sash or sashes for use of the window opening as an emergency egress opening. Each pin has a manually graspable ring at the inner side of the sash, and projects through the side of the sash and the associated hinge, being retained by a yieldable element abutting the hinge; when the pin is pulled manually in an axial direction toward the center of the sash, the latter element yields to enable extraction of the pin. The two pins respectively on the opposite sides of a sash are positioned so that they can be easily withdrawn together by pulling them toward each other. In a preferred embodiment, the yieldable element of each pin is a resilient ring seated in a groove formed around the end portion of the pin projecting beyond the hinge.

11 Claims, 9 Drawing Figures

Fig. 1.
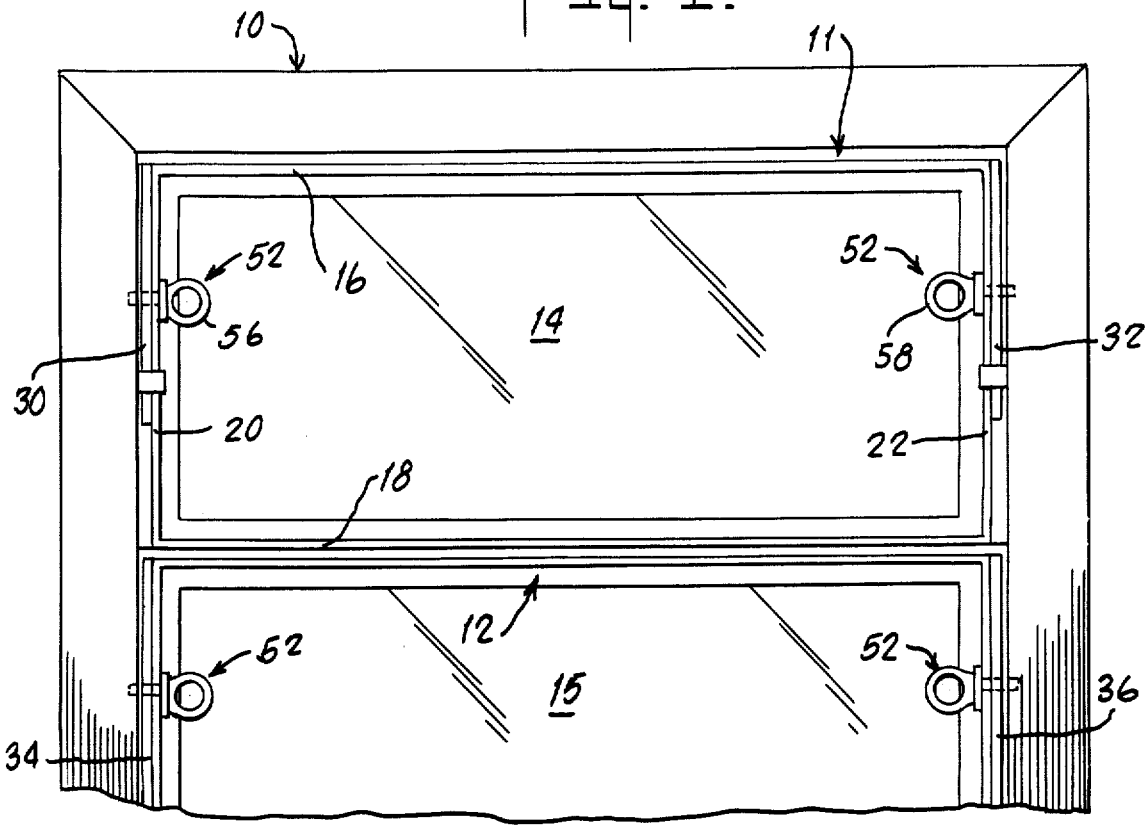
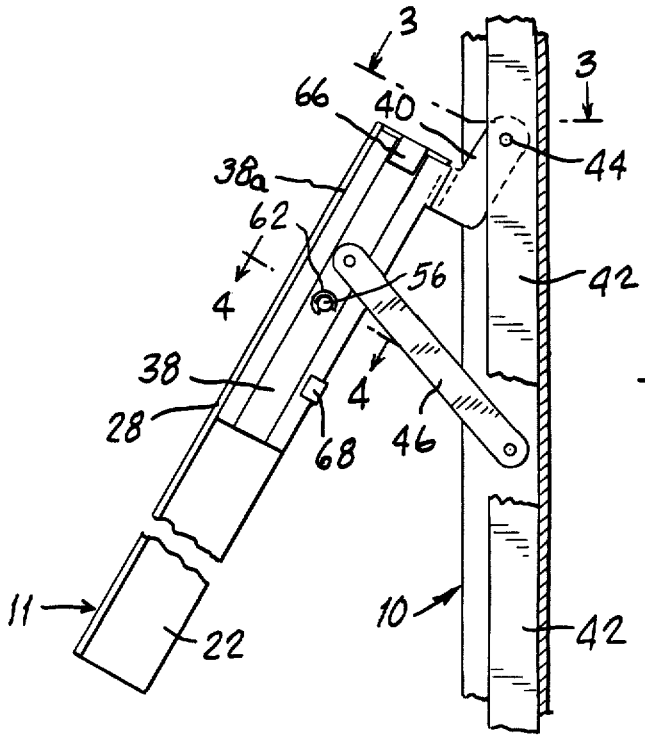
Fig. 2.

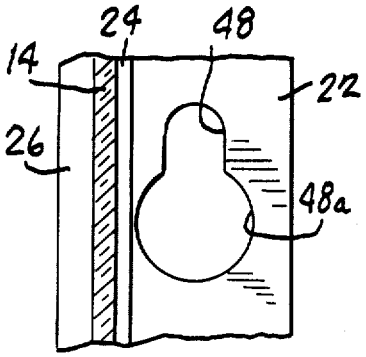
Fig. 8.
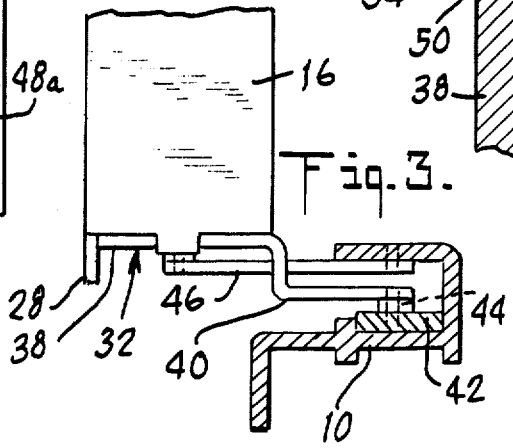
Fig. 3.
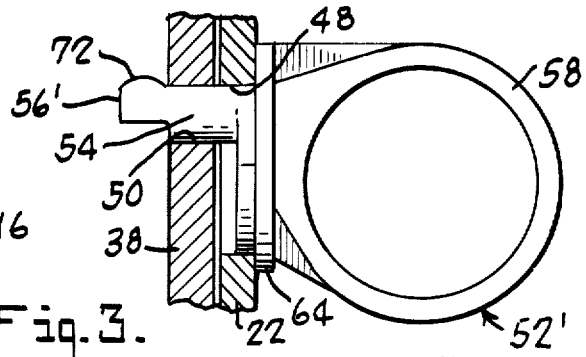
Fig. 9.
Fig. 4.
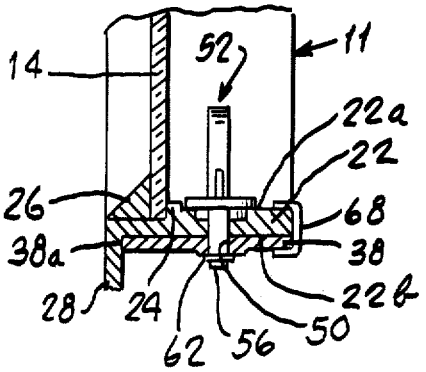
Fig. 5.
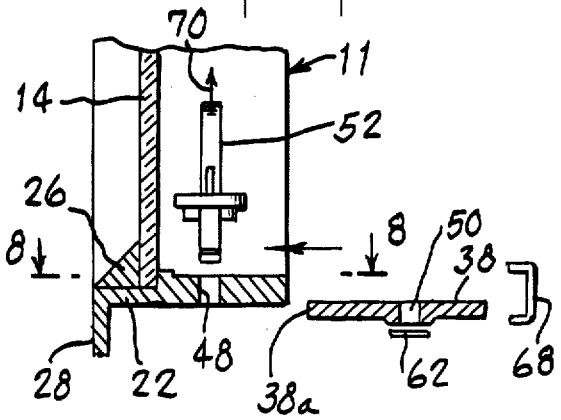
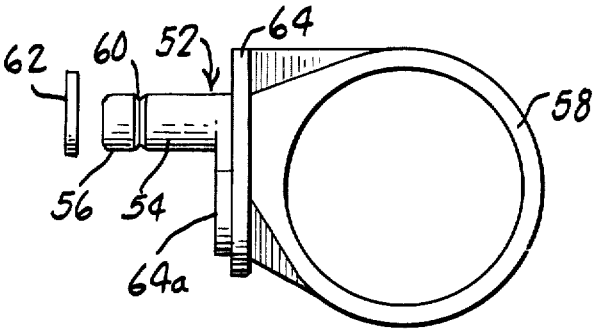
Fig. 6.
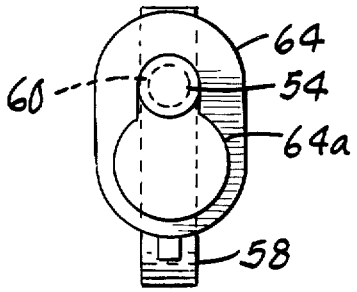
Fig. 7.

VENT-TYPE WINDOW WITH EMERGENCY EGRESS MOUNTING

BACKGROUND OF THE INVENTION

This invention relates to windows of the so-called vent or awning type and more particularly to windows of such type having emergency egress mountings, as well as to procedures for adapting vent or awning-type windows for emergency egress.

As herein contemplated, a vent or awning-type window comprises one or more panes each carried in a sash mounted for pivotal movement about a horizontal axis between open and closed positions. A typical window of this type, as widely used in residential buildings, includes two vent sashes, disposed one above another in a common frame in an exterior building wall. Each of the sashes is movably mounted in the frame by means of hinges secured to the sides of the sash and links connected to the hinges, which are also connected to vertically slidable draw bars respectively disposed along opposite sides of the frame and moved up and down (to close and open the sashes) by a conventional crank-type mechanism accessible from the building interior. A screen may be removably mounted in the frame inwardly of the sashes. It will be understood that the terms "inner" or "inwardly" and "outer" or "outwardly" as used herein refer respectively to directions toward the interior and toward the exterior of the building.

Present-day building codes commonly require that a clear opening (typically at least 5 ft.$^2$ in area, or even greater) be provided in an exterior wall of any residential room having only a single door, in order to permit egress of the room's occupants in case of fire or other emergency that prevents use of the door. An ordinary vent-type window may have an overall opening of the requisite area, but owing to the presence of plural vent sashes, which obstruct egress through the opening, such vent windows do not satisfy the aforementioned building code requirements. It is often not desirable or practicable to provide a single-vent window having a large enough opening for emergency egress, because a single vent of the requisite size is vulnerable to dislodgment by wind when open, with the result that the operating mechanism for the vent may break, or the vent may even be blown away.

Heretofore, it has been proposed to mount various kinds of windows with devices permitting the removal of sashes for emergency egress. These devices, however, have in general been unsatisfactory because of the time and force required to release a sash. Thus, if threaded elements are used, they must be unscrewed, and if (as sometimes happens) they are excessively tight, a tool such as pliers must be employed to disengage them. L-shaped pins that rotate from a locked position to a vent release position are also known, but again they are sometimes excessively tight and must be pried open with a screwdriver or other tool. For reasons of safety, it would be desirable to provide a window structure affording assured quick release of sashes in emergency situations, for clearing the window opening for egress.

SUMMARY OF THE INVENTION

The present invention contemplates the provision, in a vent-type window structure, of a vent sash, a pair of hinges for mounting the sash, and a pair of removable pins of a particular construction, one pin for each hinge, constituting the sole means for positively securing the sash to the hinges. In this combination, the sash may be a generally conventional sash structure including two opposed jamb members each having a first surface facing toward the center of the sash and a second surface facing away from the center of the sash, each jamb member having an opening extending between the first and second surfaces thereof. The hinges, which also may be generally conventional, are respectively disposed adjacent the jamb members for mounting the sash for angular movement about an axis of rotation parallel to the dimension of the sash between the jamb members; each of the hinges includes a portion overlying the second surface of the jamb member adjacent that hinge, and each of these hinge portions has an opening in register with the opening of the jamb member adjacent that hinge portion.

As a particular feature of the invention, each of the aforementioned pins (which respectively secure the jamb members to the hinges) includes an axially rectilinear shaft, extending entirely through the opening in one of the jamb members and the opening in the hinge portion overlying that jamb member and having an end portion projecting beyond the last-mentioned hinge portion away from the center of the sash; a manually engageable portion secured to the shaft and projecting from the first surface of the jamb member toward the center of the sash, for enabling a manual pulling force to be exerted on the pin in a direction toward the center of the sash; and means carried by the shaft end portion and abutting the last-mentioned hinge portion adjacent the opening therein for yieldably resisting movement of the shaft toward the center of the sash, thereby to maintain the pin in position securing the jamb member to the last-mentioned hinge portion. Further in accordance with the invention, this abutting means is yieldable, upon subjection of the pin to a sufficient manual pulling force exerted in a direction toward the center of the sash, to permit axially directed displacement of the shaft out of the openings through which the shaft extends as the pin is pulled toward the center of the sash, for releasing the sash from the hinges. In this way, the sash can easily and rapidly be removed to clear a window opening for emergency egress, without any need for tools.

In preferred embodiments, the abutting means may comprise a deformable element. For example, the abutting means may include a surface region of the pin shaft end portion defining a circumferential groove, and a C-ring or O-ring snugly fitted in the groove to abut the adjacent hinge; manually exerted, axially directed pulling force on the pin dislodges the ring to release the pin for removal. Alternatively, the shaft end portion may be formed with a flexible tab arranged to abut the hinge but shaped and dimensioned to be deflected out of abutment with the hinge, and to pass through the hinge and jamb openings, when the pin is pulled. Conveniently or preferably, the manually engageable portion of each pin is a ring formed integrally with the pin shaft. The pins are disposed inwardly of the sash window panes, and, advantageously, are aligned so that the sash can be released by grasping the two pin rings simultaneously and pulling them toward each other.

An additional feature of the invention is that it enables a conventional vent-type window, having at least one sash with associated hinges each secured to the sash by a screw, to be readily adapted for emergency egress use. To this end, the screw holes or openings in the hinges and (if necessary) in the sash jambs are enlarged to the extent required to accommodate the above-described pins, and the pins are then simply inserted, i.e. replacing and performing the securing function of the screws while permitting rapid sash removal.

Further features and advantages of the invention will be apparent from the detailed description hereinbelow set forth, together with the accompanying drawings.

BRIEF DESCRIPTION OF THE DRAWINGS

FIG. 1 is a simplified, fragmentary interior elevational view (i.e. looking outwardly) of a vent-type window embodying the present invention in a particular form;

FIG. 2 is an enlarged fragmentary side elevational view of the window of FIG. 1;

FIG. 3 is a further enlarged fragmentary sectional view taken along the line 3—3 of FIG. 2;

FIG. 4 is a similarly enlarged fragmentary sectional view taken along the line 4—4 of FIG. 2;

FIG. 5 is a view similar to FIG. 4 but illustrating removal of the sash from the window frame;

FIG. 6 is a still further enlarged, exploded elevational view of one of the egress pins incorporated in the embodiment of FIGS. 1-5;

FIG. 7 is an end elevational view of the egress pin of FIG. 6; FIG. 8 is a similarly enlarged fragmentary elevational view of one of the jamb members of the sash, taken as along the line 8—8 of FIG. 5; and FIG. 9 is a fragmentary elevational view, similar to FIG. 6, of another embodiment of the invention.

DETAILED DESCRIPTION

Referring to the drawings, the invention will be described as embodied in a vent-type window structure of generally conventional character, including a window frame 10 mountable in an exterior wall of a building and defining a rectangular window opening. Two rectangular vent sashes, respectively designated 11 and 12, and respectively having glass panes 14 and 15, are mounted one above another in the frame 10, i.e. within the frame opening. The sashes are essentially identical in structure, and are so dimensioned that each sash covers half of the frame opening when the sashes are in the closed position shown in FIG. 1.

Each sash comprises a horizontal top member or head 16, a horizontal bottom member or sill 18, and two opposed vertical side members or jambs 20 and 22 rigidly interconnecting the sill and head and, in cooperation therewith, providing a continuous mounting for the pane 14 or 15 around all four edges of the pane. Each of the members 16, 18, 20 and 22 may be a rigid metal (e.g. aluminum) element, having a first surface facing toward the center of the sash and a second surface facing away from the center of the sash; as shown in FIG. 4, which illustrates the jamb member 22 of sash 11, the first surface of each sash member is provided with a projection 24 that abuts the inner side of the edge of the pane (14 in FIG. 4) while a glazing strip 26, extending along the outer surface of the pane edge, completes the mounting of the pane in conventional manner.

Referring further to FIG. 4, the first surface 22*a* and second surface 22*b* of the jamb member 22 extend inwardly of the pane 14 and projection 24 for some distance. Outwardly of the pane, the jamb member 22 terminates in a lateral flange 28, projecting in a direction away from the center of the sash at a right angle to the surface 22*b* and extending along the length of the jamb member; this flange abuts the adjacent exterior side of the frame 10 when the sash is in its closed position to cover, and prevent exterior access to, the space between the jamb member surface 22*b* and the facing side surface of the window frame. The jamb member 20 is structurally identical to the jamb member 22 but disposed in mirror-image orientation relative thereto, it being understood that the two jamb members are parallel to each other and are respectively located at opposite sides of the sash.

The sash 11 is mounted in the frame by means of a pair of hinges 30 and 32 respectively disposed at opposite sides of the sash, i.e. respectively adjacent the two jamb members 20 and 22. These hinges are identical in structure and arrangement except that they are mirror images of each other. Similarly, the sash 12 is mounted by means of a pair of hinges 34 and 36, which may be essentially identical in structure and arrangement to the hinges 30 and 32.

Referring then in detail to the hinge 32, as exemplary of all hinges in the described window structure, this hinge includes an elongated, rectangular plate portion 38 (FIG. 2) overlying, and extending along, the second surface 22*b* of the jamb member 22; the plate portion 38 has a straight outer edge 38*a* that abuts the jamb member flange 28 along its length so as to prevent angular movement of the jamb member relative to the hinge when the jamb member and hinge are secured together as hereinafter described. Additionally, the hinge 32 includes an inwardly and laterally offset leg 40, formed integrally with or rigidly connected to the plate portion 38, and projecting above the sash head 16.

An elongated draw bar 42 is disposed within the side of the window frame 10 adjacent the jamb member 22 for vertical sliding movement within the frame, and a second similar draw bar (not shown) is mounted in like manner in the other side of the frame 10. Both draw bars are connected to a conventional crank-type window opening mechanism (not shown) mounted on the frame for access from the building interior; operation of this crank mechanism moves the two draw bars in the same direction, i.e. either down or up, with the same velocity and extent of displacement.

The upper extremity of the hinge leg 40 is connected by pivot pin 44 to the draw bar 42 so as to be angularly movable, relative thereto, about a horizontal axis of rotation, i.e. an axis parallel to the dimension of the sash 11 between the jamb members. The hinge 30 is likewise pivotally connected to the other draw bar for angular movement relative thereto about the same axis of rotation which thus constitutes the axis of rotation of the sash 11 between its open and closed positions. Similarly, the hinges 36 and 34 are respectively pivotally connected to the draw bar 42 and to the other draw bar for angular movement of the sash 12 about a horizontal axis of rotation.

At an intermediate locality in the plate portion 38, the hinge 32 is pivotally connected to a link 46 which is in turn connected to the adjacent side of the frame 10, e.g. by means of a conventional locking bearing (not shown) which, in conventional manner, defines a path of movement, for the link end remote from the hinge 32, including a locking position corresponding to fully closed position of the sash 11 such as to prevent opening of the closed sash from the exterior of the building. Similarly arranged links (not shown) are respectively associated with each of the other hinges 30, 34 and 36 in the described window structure. It will be understood that the hinges with their associated links and locking bearings, the draw bars, and the crank mechanism cooperatively function to move the two sashes 11 and 12 pivotally, about their respective horizontal axes of rotation, between the closed position shown in FIG. 1 in which the sash panes are oriented vertically, and the open position shown (for sash 11) in FIG. 2, wherein the sash is angularly displaced upwardly and outwardly about its axis of rotation. As indicated, the details of construction and operation of these elements are all well known to those skilled in the art, and accordingly need not be further described. It will be further understood that these and other conventional features of the window structure have been simplified in or even omitted from the drawing, for the sake of simplicity and clarity of illustration of the present invention, i.e. insofar as the details of these conventional features are not material to the invention.

The sash 11 is secured to the window frame 10 only through the hinges 30 and 32 so that, when disconnected from the hinges, it is immediately removable from the window frame. The sash 12 is connected in like manner only through the hinges 34 and 36 so as to be similarly removable when disconnected from its hinges. The structure and arrangement of the interconnection between each sash and its associated hinges, now to be described with particular reference to the connection of jamb member 22 of sash 11 to the hinge 32, constitute important features of the present invention.

In accordance with the invention, the jamb member has an opening 48 extending between its first and second surfaces, and the hinge portion 38 has an opening 50 in register with the jamb member opening 48, both of these openings being axially parallel to the axis of rotation of the sash 11. Through the aligned openings 48 and 50, there is inserted a pin 52 for securing the jamb member 22 to the hinge 32. This pin constitutes the sole element positively securing the latter jamb member to its associated hinge. An identical pin 52 constitutes the sole means of positively securing the other jamb member 20 of sash 11 to the hinge 30. Thus, removal of the two pins 52 completely disconnects the sash 11 from the window frame 10, permitting immediate removal of the sash from the frame. In the same way, the sash 12 is positively secured to the hinge 34 only by a single one of the pins 52, and is positively secured to the hinge 36 only by another single pin 52, which, when removed, completely disconnect the sash 12 from the frame 10 so that it likewise can be immediately removed from the frame.

As best seen in FIGS. 4–7, each of the pins 52, in the embodiment there shown, includes an axially rectilinear shaft 54 dimensioned to extend entirely through the openings 48 and 50, and having an end portion 56 which projects beyond the hinge plate portion 38, in a direction away from the center of the sash, when the pin is fully inserted as shown in FIG. 4. Additionally, each pin includes a manually engageable portion, such as the manually graspable ring 58 shown in FIGS. 4–7, secured to (and preferably formed integrally with) the shaft 54 so as to project from the first surface 22*a* of the jamb member 22 toward the center of the sash, i.e. when the pin is inserted as shown in FIG. 4. Thus, the ring 58 is formed at the end of the shaft 54 remote from the end portion 56. The ring 58 serves to enable a manual pulling force to be exerted on the pin in a direction, toward the center of the sash, coincident with the axis of the pin shaft 54.

The end portion 56 of the pin shaft carries means for abutting the hinge plate portion (38 in FIGS. 4 and 5) beyond which it projects, adjacent the opening 50, for yieldably resisting movement of the shaft 54 toward the center of the sash, thereby to maintain the pin in position securing the jamb member (22 in FIG. 4) to its associated hinge plate portion (38 in FIG. 4). This abutting means is yieldable, upon subjection of the pin to a sufficient manual pulling force asserted through the ring 58 in the aforementioned direction, to permit axially directed displacement of the pin shaft out of the jamb member and hinge openings through which the shaft extends as the pin is pulled toward the center of the sash, for releasing the sash from the hinge.

In the embodiment of FIGS. 4–7, the last-mentioned abutting means comprises a surface region of the shaft end portion 56 defining a circumferential groove 60 in which a deformable C-ring or O-ring 62 is snugly received. When the pin 52 connecting the jamb member 22 to the hinge plate portion 38 is fully inserted through the holes 48 and 50, i.e. such that the enlarged portion 64 of the pin adjacent ring 58 abuts the first surface 22*a* of the jamb member, the groove 60 is disposed just beyond the hinge plate portion 38 (in a direction away from the center of the sash); the C-ring or O-ring 62 then fitted into the groove 60 abuts the surface of the hinge portion 38 immediately adjacent the opening 50, as shown in FIG. 4, to restrain the pin against movement in a direction toward the center of the sash, and thereby to secure the jamb member and hinge plate portion fixedly together so that the sash 11 moves with the hinge 32. That is to say, the jamb member and hinge plate portion are then held together between the ring 62 and the enlarged flange portion 64 of the pin.

The opening 48 in the jamb 22 may, as shown in FIG. 8, be formed with an eccentric enlargement 48*a* which conformingly receives a similarly shaped projection 64*a*, eccentric to the pin shaft 54, formed on the side of the pin flange portion 64 away from the center of the sash, to prevent rotation of the pin 52, and thus to maintain the ring 58 of the pin in the orientation shown in FIG. 1.

Assembly of the illustrated structure is readily performed by appropriately positioning the sash 11 in relation to its associated hinges, inserting the shaft 54 of one of the pins 52 successively through the opening 48 in the jamb member 22 and through the opening 50 in the hinge plate portion 38, in a direction away from the center of the sash, and forcing the C-ring or O-ring 62 over the projecting end portion 56 of the pin into its seat in groove 60, this procedure being repeated for the other pin 52 on the other side of the sash 11. When it is desired to remove the sash 11 from the window frame, the person removing the sash inserts a finger of one hand through one of the rings 58, and a finger of the other hand through the other ring 58 and pulls both rings toward the center of the sash, i.e. in the direction indicated by arrow 70 in FIG. 5, thereby forcing the C-ring or O-ring 62 of each pin out of its groove and over the end portion of the pin so that the pin may be withdrawn. Preferably, the openings for the two pins 52 of sash 11 are aligned on a common horizontal axis to facilitate their simultaneous withdrawal from their respective hinges. It is further preferred that each pin be so designed that removal of the pin requires a pulling force of at least about 5 pounds but not more than about 10 pounds.

In an illustrative example of a pin structure releasable with such pulling force, the entire pin body including the ring 58, flange portion 64, and shaft 54 with its end portion 56 are formed as a unitary molded element of 15% glass-fiber-filled nylon having a shaft diameter of 0.172 inch. The groove 60 has a width (dimension along the axis of the shaft) of 0.010 inch and a depth of 0.003 inch, with a V-shaped profile. An 0.165-inch inner diameter C-ring is used as the ring 62, fitted into this groove. The hole 50 in the hinge plate portion through which the pin shaft extends, has a diameter of 0.180 inch, and the diameter of the hole 48 in the jamb member, or that portion of the latter opening through which the pin shaft extends, has a diameter of at least 0.180 inch.

Although, as stated, the pins 52 constitute the sole means for positively securing the sashes to the hinges, auxiliary retaining means may be provided for preventing the sash from falling as the pins are removed while enabling the sash to be separated from the hinges thereafter by direct application of manual force (e.g. with a simple pushing and/or lifting motion) to the sash. For example, a longitudinal stiffening rib **38*b* (FIG. 2) may be formed in each hinge plate portion 38, such that the exposed surface of the plate portion 38 has a shallow channel or groove which receives a tab 66 projecting from the adjacent end portion of the sash head member 16, the tab being bent downwardly to overlie and engage the plate portion 38. Additionally, or alternatively, a spring clip 68 may be fitted over an edge of each jamb member and the adjacent edge of its associated hinge plate portion 38, in the manner shown in FIGS. 2 and 4**, to hold them together. With either or both of these auxiliary retaining arrangements, the sash is retained in place on the hinges as the pins are removed, and is thus kept from falling, but there is nothing (i.e. other than the pins) that positively prevents separation of the sash from the hinges upon application of appropriately directed manual force to the sash.

In the alternative embodiment shown in FIG. 9, the end portion 56' of the pin 52' (projecting beyond the hinge plate portion 38) is again formed integrally with the remainder of the pin shaft 54' but has a reduced thickness relative to the remainder of that shaft, and also bears a lateral projection 72 for abutting a portion of the hinge plate portion surface adjacent the opening 50. Owing to its reduced thickness, the end portion 56' is deflectable to permit insertion and withdrawal through the openings 48 and 50, the projection 72 being dimensioned to permit such insertion and withdrawal and having rounded surfaces to facilitate the same. As will be appreciated, in both instances the abutting means of the pin 52 or 52' is deformable so as to enable withdrawal of the pins, and consequent separation of the sash from the hinges, by applied manual pulling force.

The present invention enables ready adaptation of conventional vent-type windows to provide emergency egress openings. Typically in such conventional windows, each jamb member of a sash is secured to the plate portion of its associated hinge by a screw, for example a #10X 3/16-inch screw. To convert a sash in such a window for emergency egress purposes, the screw holes in the hinge plate portions are simply enlarged (to a diameter of 0.180 inch for the example of dimensions given above), with corresponding enlargement of the jamb member openings if necessary; and, in place of the screws, pins 52 are inserted and secured in place in the manner described above. Each sash thus converted is thereby made immediately removable, without need to provide further or auxiliary structures. If the window has plural vents or sashes, it may be sufficient to connect one of them as described, i.e. if an egress opening of adequate dimensions can be achieved by removal of just one of the sashes.

As shown, the pins 52 are located inwardly of the panes 14 or 15 of the sashes, and the pin portions projecting beyond the hinge plate portions are shielded from exterior access, when the windows are closed, by the jamb member flanges 28. Consequently, the windows are secure against removal from the exterior. Additionally, the pins 52 provide a relatively childproof means for removing sashes rapidly from a window frame. Commonly, a screen (not shown) is mounted in the window frame inwardly of the sashes, and in such case the screen inhibits child access to the pins. Removal of one or more pins 52 by a child when the sashes are closed has no effect, because the sashes must be in open position before they can be removed by withdrawal of the pins. Even if a sash is open, a child would have to remove both pins 52 securing the sash to its hinges, because if only one pin were removed, the sash would hang on the other pin.

It is to be understood that the invention is not limited to the features and embodiments hereinabove specifically set forth, but may be carried out in other ways without departure from its spirit.

I claim:

1. In a vent-type window structure, in combination, (a) a vent sash including two opposed jamb members each having a first surface facing toward the center of the sash and a second surface facing away from the center of the sash;

(b) a pair of hinges respectively disposed adjacent said jamb members for mounting the sash for angular movement about an axis of rotation parallel to the dimension of the sash between the jamb members, each of said hinges including a portion overlying the second surface of the jamb member adjacent that hinge;

(c) each of said jamb members having an opening extending between the first and second surfaces thereof, and each of said hinge portions having an opening in register with the opening of the jamb member adjacent that hinge portion;

(d) a pair of pins for respectively securing said jamb members to said hinges, each of said pins including (i) an axially rectilinear shaft extending entirely through the opening in one of said jamb members and the opening in the hinge portion overlying that jamb member and having an end portion projecting beyond said last-mentioned hinge portion away from the center of the sash, (ii) a manually engageable portion secured to said shaft and projecting from the first surface of said one jamb member toward the center of the sash, for enabling a manual pulling force to be exerted on the pin in a direction toward the center of the sash; and (iii) means carried by said end portion and abutting said last-mentioned hinge portion adjacent the opening therein for yieldably resisting movement of the shaft toward the center of the sash, thereby to maintain the pin in position securing said one jamb member to the last-mentioned hinge portion, said abutting means being yieldable, upon subjection of the pin to a sufficient manual pulling force exerted in a direction toward the center of the sash, to permit axially directed displacement of said shaft out of the openings through which the shaft extends as the pin is pulled toward the center of the sash, for releasing the sash from said hinges, said pins being the only means positively securing said sash to said hinges.

2. Window structure as defined in claim 1, wherein all of said openings are axially parallel to said axis of rotation.

3. Window structure as defined in claim 1, wherein said abutting means of each pin comprises a deformable element.

4. Window structure as defined in claim 3, wherein said abutting means comprises a surface region of the pin shaft end portion defining a circumferential groove, and a deformable ring snugly fitting in said groove and abutting said last-mentioned hinge portion.

5. Window structure as defined in claim 3, wherein said abutting means comprises a flexible tab formed integrally with the pin shaft end portion and shaped and dimensioned to be deflectable out of abutment with the last-mentioned hinge portion and to pass through the openings through which the pin shaft extends, upon application of sufficient manual pulling force to the pin as aforesaid.

6. Window structure as defined in claim 1 or 3, wherein said manually engageable portion of each pin comprises a ring formed integrally with the pin shaft.

7. Window structure as defined in claim 6, wherein each of said pins further includes a projection eccentric to said shaft at the extremity of said shaft adjacent said ring, and wherein each of said jamb member openings includes a portion shaped to conformingly receive said eccentric projection.

8. Window structure as defined in claim 2, wherein all said openings are disposed along a common axis.

9. Window structure as defined in claim 1, further including a window frame, having an inwardly facing side and an outwardly facing side, within which said sash is disposed and said hinges are mounted, wherein said sash includes a window pane mounted between said jamb members and wherein said openings are disposed inwardly of said pane.

10. A method of converting, to an emergency egress opening, a vent-type window having at least one vent sash including two opposed jamb members each having a first surface facing toward the center of the sash and a second surface facing away from the center of the sash; and a pair of hinges for each sash, respectively disposed adjacent said jamb members for mounting the sash for angular movement about an axis of rotation parallel to the dimension of the sash between the jamb members, each of said hinges including a portion overlying the second surface of the jamb member adjacent that hinge; each hinge being adapted to be secured to its associated jamb member by a screw, each of said jamb members having an opening extending between the first and second surfaces thereof, and each of said hinge portions having a screw hole in register with the opening of the jamb member adjacent that hinge portion, all of said openings and screw holes being axially parallel to said axis of rotation; said method comprising:

(a) enlarging said screw holes of the hinges of said one sash and, if necessary, said jamb member openings of said one sash, to a predetermined diameter, and (b) in place of the screws which would otherwise secure the jamb members of said one sash to the hinges thereof, inserting, through each of said openings and the enlarged screw hole in register therewith, one of a pair of pins for respectively securing said jamb members of said one sash to said hinges thereof, each of said pins including (i) an axially rectilinear shaft extending entirely through the opening in one of said jamb members and the enlarged screw hole in the hinge portion overlying that jamb member and having an end portion projecting beyond said last-mentioned hinge portion away from the center of the sash, (ii) a manually engageable portion secured to said shaft and projecting from the first surface of said one jamb member toward the center of the sash, for enabling a manual pulling force to be exerted on the pin in a direction toward the center of the sash; and (iii) means carried by said end portion and abutting said last-mentioned hinge portion adjacent the opening therein for yieldably resisting movement of the shaft toward the center of the sash, thereby to maintain the pin in position securing said one jamb member to the last-mentioned hinge portion, said abutting means being yieldable, upon subjection of the pin to a sufficient manual pulling force exerted in a direction toward the center of the sash, to permit axially directed displacement of said shaft out of the openings through which the shaft extends as the pin is pulled toward the center of the sash, for releasing the sash from said hinges, (c) the inserting step comprising advancing the shaft of one of said pins, end portion first, successively through said openinq of said one jamb member and through the enlarged screw hole in register with the last-mentioned opening until the manually engageable portion of the pin abuts the first surface of said one jamb member.

11. A method according to claim 10, wherein said abutting means of each pin comprises a surface region of the shaft end portion defining a circumferential groove and a ring snugly receivable in said groove, said method further including, after said inserting step, the step of fitting a ring as aforesaid over the end portion of the pin shaft and moving the ring toward the center of the sash until the ring is received in said groove.

* * * * *